US008653755B2

(12) United States Patent
Esaki et al.

(10) Patent No.: US 8,653,755 B2
(45) Date of Patent: Feb. 18, 2014

(54) LIGHTING APPARATUS AND ILLUMINATING FIXTURE WITH THE SAME

(71) Applicant: Panasonic Corporation, Osaka (JP)

(72) Inventors: Sana Esaki, Osaka (JP); Akinori Hiramatu, Nara (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/673,499

(22) Filed: Nov. 9, 2012

(65) Prior Publication Data

US 2013/0141016 A1 Jun. 6, 2013

(30) Foreign Application Priority Data

Dec. 5, 2011 (JP) ..... 2011-265719

(51) Int. Cl.
*H05B 37/02* (2006.01)
*H05B 33/08* (2006.01)

(52) U.S. Cl.
CPC ..... *H05B 37/02* (2013.01); *H05B 33/08* (2013.01)
USPC ..... 315/307; 315/224; 315/186; 315/254

(58) Field of Classification Search
CPC ..... H05B 37/02; H05B 33/08
USPC ..... 315/291, 307, 186, 200 R, 224, 254
See application file for complete search history.

(56) References Cited

U.S. PATENT DOCUMENTS

| | | | | |
|---|---|---|---|---|
| 8,497,636 | B2 * | 7/2013 | Nerone | 315/210 |
| 8,581,498 | B1 * | 11/2013 | Cheung et al. | 315/121 |
| 2011/0115403 | A1 * | 5/2011 | De Smit | 315/291 |
| 2012/0019714 | A1 * | 1/2012 | Hiramatu et al. | 348/370 |
| 2012/0249001 | A1 * | 10/2012 | Okubo et al. | 315/200 R |
| 2013/0099690 | A1 * | 4/2013 | Kim et al. | 315/210 |
| 2013/0113380 | A1 * | 5/2013 | Kim et al. | 315/121 |
| 2013/0264964 | A1 * | 10/2013 | Luo et al. | 315/289 |

FOREIGN PATENT DOCUMENTS

| | | | |
|---|---|---|---|
| JP | 2005-294063 | A | 10/2005 |
| WO | 01/58218 | A1 | 8/2001 |

* cited by examiner

*Primary Examiner* — Don Le
(74) *Attorney, Agent, or Firm* — Renner, Otto, Boisselle & Sklar, LLP

(57) ABSTRACT

A control circuit selects a first control mode in which a switching element is turned on/off so as to flow current in an inductor in a continuous mode by which the current flows in the inductor without a sleep period, thereby fully lighting a light source load. The control circuit selects one of a second control mode in which a turn-on time of the switching element is changed and a third control mode in which an oscillating frequency is changed according to an interval, to which the designated dimming ratio corresponds, to light the light source load. An output capacitor connected between output terminals of a step-down chopper circuit smoothes a pulsation component of an output current supplied to the light source load and has capacity set so that a ripple ratio of the output current is less than 0.5 at the full lighting of the light source load.

7 Claims, 10 Drawing Sheets

LIGHTING APPARATUS AND ILLUMINATING FIXTURE WITH THE SAME

TECHNICAL FIELD

The present invention relates to a lighting apparatus capable of dimming a semiconductor light emitting element and an illuminating fixture with the same.

BACKGROUND ART

Recently, illuminating fixtures using a semiconductor light emitting element such as a light emitting diode (an LED), an organic electroluminescence (EL), and the like, as a light source load have been proliferated. The type of illuminating fixture is provided with, for example, a lighting apparatus (an LED lighting apparatus) disclosed in Japanese Patent Application No. 2005-294063 (hereinafter referred to as a "Document 1").

The lighting apparatus in Document 1 is a self-excited type and does not have a dimming function. It is therefore impossible to dim the light source load.

Meanwhile, International Publication Number WO 01/58218 A1 (hereinafter referred to as a "Document 2") discloses that supply power to a light source load (an LED lighting module) is turned on and off at a burst frequency of 100 Hz or 120 Hz synchronized with a frequency (50 or 60 Hz) of an AC power supply (a main power supply voltage). The lighting apparatus (a power supply assembly) can control a length of a pulse in which the supply power to the light source load is in an On state, thereby performing a dimming control. However, a specific circuit configuration for dimming is not disclosed in Document 2.

In addition, in the lighting apparatus as described in Document 2 which is configured to perform dimming by controlling a pulse length (an On time), when a dimming ratio is small (dark), the On time in one period of the burst frequency is short, which may cause flicker. For this reason, in the lighting apparatus, a range of selectable dimming ratios is difficult to be set widely.

SUMMARY OF INVENTION

The present invention is directed to a lighting apparatus capable of widening a dimming range of a light source load with a relatively simple configuration, and an illuminating fixture with the same.

According to an aspect of the present invention, a lighting apparatus includes a switching element connected to a DC power supply in series and controlled to be turned on/off at high frequency; an inductor connected to the switching element in series to flow current from the DC power supply therein when the switching element is turned on; a diode that discharges electromagnetic energy stored in the inductor, when the switching element is turned on, to a light source load formed of a semiconductor light emitting device when the switching element is turned off; an output capacitor connected in parallel with the light source load and smoothing a pulsation component due to the turning on/off of the switching element for an output current supplied to the light source load; and a control circuit that controls the turning on/off operation of the switching element, wherein the control circuit includes, as a control mode of the switching element, a first control mode in which the switching element is turned on/off at a predetermined oscillation frequency and a turn-on time so as to flow a current in a continuous mode in which the current flows continuously through the inductor, a second control mode in which the oscillation frequency of the switching element is fixed and the turn-on time of the switching element is changed, and a third control mode in which the turn-on time of the switching element is fixed and the oscillation frequency of the switching element is changed, wherein the second control mode and the third control mode being allocated for at least two intervals defined by dividing a dimming range between a minimum dimming ratio and a maximum dimming ratio, wherein the control circuit is adapted, when a full lighting mode is designated, to select the first control mode to fully light the light source load, and when a dimming ratio is designated from the dimming range, to select one of the second control mode and the third control modes according to the interval, to which the dimming ratio corresponds, to dim the light source load at the designated dimming ratio.

According to another aspect of the present invention, in the lighting apparatus, the output capacitor has capacity set so that a ripple ratio of the output current is less than 0.5 when the light source load is fully lit.

According to yet another aspect of the present invention, the lighting apparatus further includes a current sensing unit that senses the current flowing in the switching element and a capacitor charged by a driving signal of the switching element, wherein the control circuit turns off the switching element when the current sensed by the current sensing unit reaches a predetermined first value and turns on the switching element when a value of a voltage across the capacitor is a predetermined threshold value or less, and wherein the control circuit is adapted, to change the turn-on time of the switching element by changing the first value and to change the oscillation frequency of the switching element by changing a second predetermined value determining a discharge speed of the capacitor.

According to yet another aspect of the present invention, in the lighting apparatus, the control circuit sets at least one of the first value and the second value to be zero or less to stop the turn-on/off operation of the switching element thereby turns off the light source load.

According to yet another aspect of the present invention, in the lighting apparatus, the control circuit receives a dimming signal from outside to select the control mode of the switching element according to the dimming ratio determined by the dimming signal.

According to yet another aspect of the present invention, in the lighting apparatus, the control circuit sets the oscillation frequency of the switching element to be in a range of 1 kHz or more.

According to yet another aspect of the present invention, an illuminating fixture includes the lighting apparatus according to any one of above aspects and the light source load supplied with power from the lighting apparatus.

The present invention can widen the dimming range of the light source load with a relatively simple configuration.

BRIEF DESCRIPTION OF DRAWINGS

Preferred embodiments of the invention will now be described in further details. Other features and advantages of the present invention will become better understood with regard to the following detailed description and accompanying drawings where.

DESCRIPTION OF EMBODIMENTS (First Embodiment)

Figure 1:
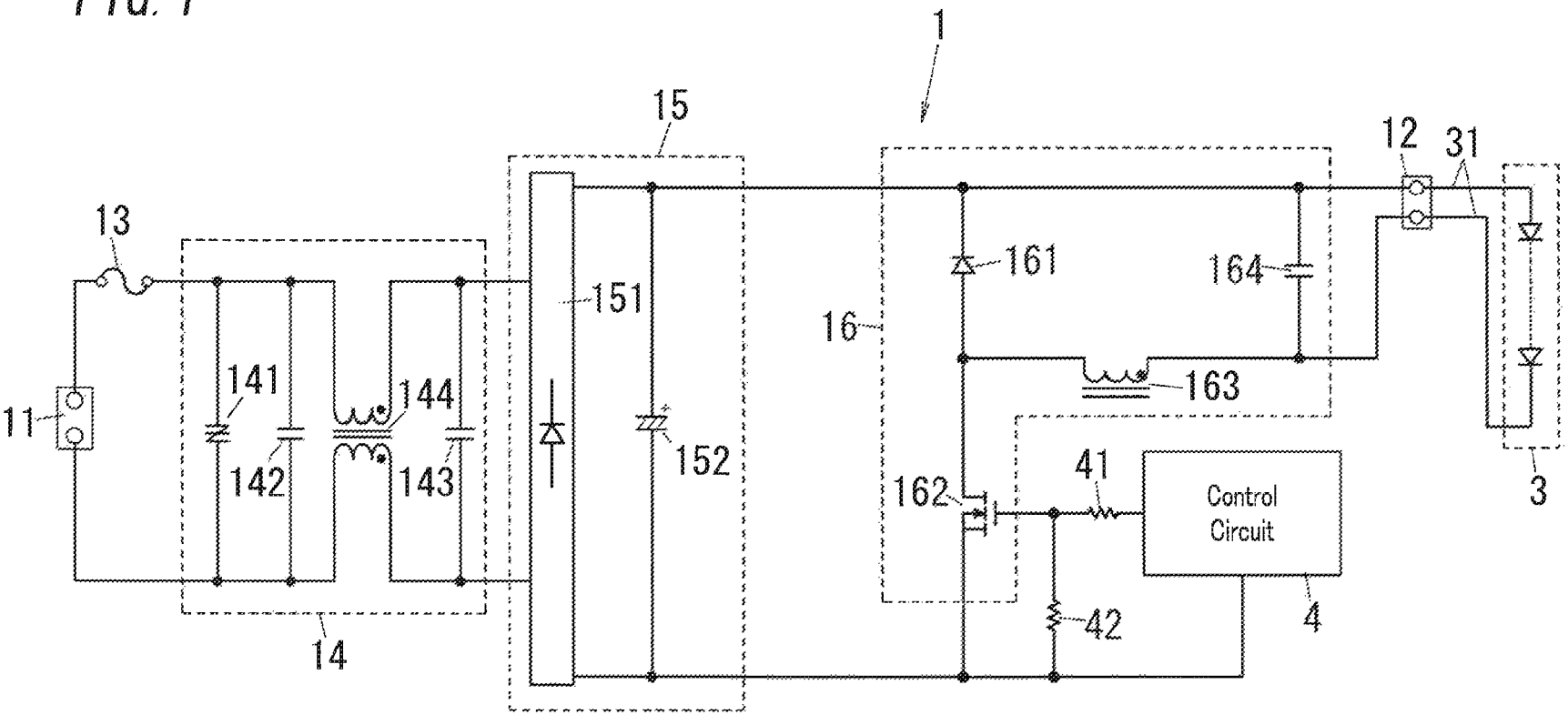
FIG. 1 is a circuit diagram showing the configuration of a lighting apparatus according to a first embodiment of the present invention.

As shown in FIG. 1, a lighting apparatus 1 according to an embodiment of the present invention includes: a power supply connector 11 adapted to be connected to an AC power supply 2 (see FIG. 8) such as a commercial power supply; and an output connector 12 adapted to be connected to a light source load 3 comprising a semiconductor light emitting element such as a light emitting diode (LED) through lead wires 31. The light source load 3 is adapted to be lit by a DC output current supplied from the lighting apparatus 1. The light source load 3 may be an LED module formed of a plurality of (for example, thirty) light emitting diodes connected in series, in parallel, or in series and parallel.

The lighting apparatus 1 is configured to light the light source load 3 at a desired brightness (desired dimming level) according to a dimming ratio designated from outside. The lighting apparatus 1 includes: a DC power supply generation unit having a filter circuit 14 and a DC power supply circuit 15; a step-down chopper circuit (a buck converter) 16; and a control circuit 4, as main components. A basic configuration of the lighting apparatus 1 will be hereinafter described with reference to FIG. 1.

The power supply connector 11 is connected to the DC power supply circuit 15 through a current fuse 13 and the filter circuit 14. The filter circuit 14 includes: a surge voltage absorbing device 141 and a filter capacitor 142 connected in parallel with the power supply connector 11 through the current fuse 13; a filter capacitor 143; and a common mode choke coil 144, and is adapted to cut noise. The filter capacitor 143 is connected between input terminals of the DC power supply circuit 15, and the common mode choke coil 144 is inserted between the two filter capacitors 142 and 143.

Herein, the DC power supply circuit 15 is a rectified smoothing circuit including a full-wave rectifier 151 and a smoothing capacitor 152, but it is not limited thereto. For example, the DC power supply circuit 15 may be a power correction circuit (a power factor improving circuit) including a step-up chopper circuit. By the above configuration, the DC power supply generation unit including the filter circuit 14 and the DC power supply circuit 15 converts an AC voltage (100 V, 50 or 60 Hz) from the AC power supply 2 into a DC voltage (about 140 V) and outputs the converted DC voltage from the output terminals (both terminals of the smoothing capacitor 152) thereof. The output terminals (both terminals of the smoothing capacitor 152) of the DC power supply circuit 15 are connected to the step-down chopper circuit 16, and output terminals of the step-down chopper circuit 16 are connected to the output connector 12.

The step-down chopper circuit 16 includes: a diode (a regenerative diode) 161 and a switching element 162 connected in series to each other and connected between the output terminals of the DC power supply circuit (the DC power supply) 15; and an inductor 163 connected in series to the light source load 3 between both ends of the diode 161. In this configuration, the diode 161 is installed so that a cathode of the diode 161 is connected to an output terminal of a positive side of the DC power supply circuit 15. That is, the switching element 162 is arranged to be inserted between a serial circuit of the inductor 163 and the light source load 3 connected in parallel with the diode 161, and an output terminal of a negative side of the DC power supply circuit 15. A function of the diode 161 will be described below.

The step-down chopper circuit 16 also includes an output capacitor 164 between output terminals thereof (between both terminals of the output connector 12). The output capacitor 164 is connected in parallel with the light source load 3. That is, in the step-down chopper circuit 16, the output capacitor 164 is connected between both ends of a serial circuit of the diode 161 and the inductor 163. Both ends of the output capacitor 164 are connected to the output connector 12. The output capacitor 164 serves to smooth a pulsation component of the output current supplied to the light source load 3 from the output connector 12. The output capacitor 164 will be described below in detail.

Figure 6:
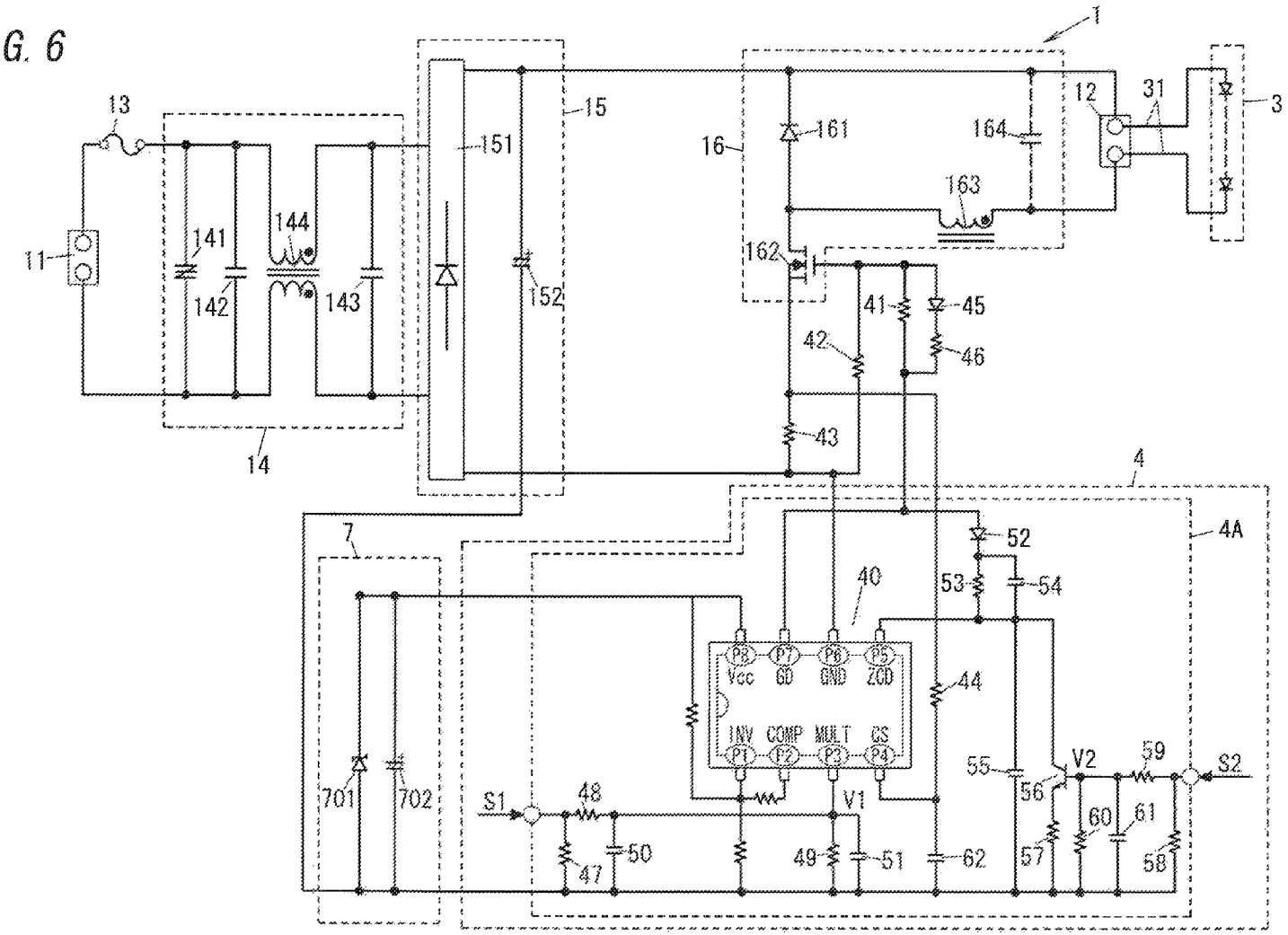
FIG. 6 is a circuit diagram showing the configuration of the lighting apparatus according to the first embodiment.

The control circuit 4 includes a driver circuit 4A (see FIG. 6). The control circuit 4 is adapted to turn on and off the switching element 162 of the step-down chopper circuit 16 at a high frequency. In an example of FIG. 1, the switching element 162 includes a metal oxide semiconductor field effect transistor (MOSFET). The control circuit 4 is adapted to supply a gate signal between a gate and a source of the switching element 162, thereby turning the switching element 162 on and off. More specifically, the control circuit 4 outputs a gate signal (see FIG. 2B) having a rectangular wave form in which a high (H) level and a low (L) level are alternately repeated. The switching element 162 is turned on when the gate signal is in a period of the H level, and turned off when the gate signal is in a period of the L level. In the example of FIG. 1, an output terminal for the gate signal from the control circuit 4 is connected to the output terminal of a negative side of the DC power supply circuit 15 through a serial circuit of resistors 41 and 42. A connection point of the two resistors 41 and 42 is connected to a gate terminal of the switching element 162.

That is, the control circuit 4 adjust an On time and an oscillating frequency (switching frequency; inverse of on-off period length) of the switching element 162 according to the dimming ratio designated from the outside. In detail, the control circuit 4 is configured to output the gate signal in accordance with the dimming ratio toward the switching element 162. The gate signal is composed of a voltage signal.

The gate signal has an on-period in which the voltage value is H level and an off-period in which the voltage value is L level, and alternately repeats the on-period and the off-period. The on-period of the gate signal is comparable to the On time of the switching element 162. The inverse of one period length (inverse of sum of the on-period and the off-period) of the gate signal is comparable to the oscillating frequency of the switching element 162.

Here, in the embodiment, the control circuit 4 has three modes, that is, a first control mode, a second control mode, and a third control mode as control modes of the switching element 162. The control circuit 4 is adapted to select the first control mode to fully light the light source load 3 when a full lighting mode is designated from the outside. The control circuit 4 is adapted to select the second control mode or the third control mode according to the dimming ratio designated from the outside, thereby dimming the light source load 3 based on the designated dimming ratio. Here, the dimming ratio is selected from a dimming range between a minimum dimming ratio and a maximum dimming ratio. The dimming range is divided into a plurality (at least two) of intervals (dimming intervals), and the second control mode or the third control mode is previously allocated for each of at least two intervals of the divided intervals. That is, the dimming range is divided into a plurality of "dimming intervals". The second control mode is allocated to at least one dimming intervals and the third control mode is allocated to at least one dimming intervals. And in the embodiment, either the second control mode or the third control mode is previously allocated for each of the plurality of dimming intervals. In the embodiment, the minimum dimming ratio is 0%, and the maximum dimming ratio is 100%. Each of the dimming intervals has a first end (upper limit) and a second end (lower limit).

In the first control mode, the control circuit 4 is adapted to turn the switching element 162 on and off at predetermined oscillating frequency and predetermined On time (an On time per one period) so that, as a continuous mode, a current (an electric current) continuously flows through the inductor 163. The continuous mode mentioned herein is a mode in which the current flows through the inductor 163 without generating a sleep period (an interval in which a current becomes zero). In the second control mode, the control circuit 4 is adapted to approximately fix the oscillating frequency of the switching element 162 within each of the aforementioned intervals and to change the On time of the switching element 162. Unlike the second control mode, in the third control mode, the control circuit 4 is adapted to approximately fix the On time of the switching element 162 within each of the intervals and to change the oscillating frequency of the switching element 162.

The control circuit 4 is adapted to select the first control mode to fully light the light source load 3, if the full lighting mode for fully lighting the light source load 3 is designated. Meanwhile, if a dimming mode for dimming the light source load 3 at a dimming ratio is designated, the control circuit 4 is adapted to select one of the second and third control modes according to an interval corresponding to the designated dimming ratio, thereby dimming the light source load 3 according to the designated dimming ratio.

Here, in each of the intervals (dimming intervals) allocated to the second control mode, a frequency as a preset value is previously allocated for the oscillating frequency. Thus, the oscillating frequency is approximately fixed within the interval for which the second control mode is allocated. Also, in each of the dimming intervals allocated to the second control mode, a preset range is previously allocated for a range of the On time. The On time is selected from among this preset time range allocated to this interval, in accordance with the designated dimming ratio.

In contrast, in each of the intervals (dimming intervals) allocated to the third control mode, a time as a preset value is previously allocated for the On time. Thus, the On time is approximately fixed within the interval for which the third control mode is allocated. Also, in each of the dimming intervals allocated to the third control mode, a preset range is previously allocated for a range of the oscillation frequency. The oscillation frequency is selected from among this preset frequency range allocated to this interval, in accordance with the designated dimming ratio.

For example, when a dimming ratio corresponding to an interval to which the second control mode being allocated is designated, the control circuit 4 selects the second control mode and approximately fixes the oscillating frequency to the preset value (the oscillating frequency) that is allocated to the interval and changes the On time within the preset time range, and to dim the light source load 3. On the other hand, when a dimming ratio corresponding to an interval to which the third control mode being allocated is designated, the control circuit 4 selects the third control mode and approximately fixes the On time to the preset value (On time) that is allocated to the interval and changes the oscillating frequency within the preset frequency range, and to dim the light source load 3.

Here, in all the first to third control modes, a pulsation caused by the turning on and off of the switching element 162 occurs in an output current supplied to the light source load 3. Therefore, the step-down chopper circuit 16 smoothes the pulsation component through the output capacitor 164. Here, the capacity of the output capacitor 164 is set so that a ripple ratio (a ripple content ratio) of the output current smoothed when the light source load 3 is fully lit (that is, when the first control mode is selected) is less than 0.5. The ripple ratio mentioned herein represents a content ratio of pulsation (ripple) component of an output current. The ripple ratio is defined as a value (Ipp/Ia) obtained by dividing a variation width Ipp (=Imax−Imin) of the output current defined by maximum and minimum values (Imax and Imin) of the output current by an average value Ia of the output current.

Next, an example of an operation of the foregoing lighting apparatus 1 is described below with respect to a full lighting state in which the light source load 3 is fully lit and each of first to third dimming states in which the light source load 3 is dimmed. In this example, the dimming range includes a "first dimming interval", a "second dimming interval", and a "third dimming interval" as the "plurality of dimming intervals".

The first dimming interval is defined as an interval in which the dimming ratio is N1% to N2% (N1>2). Herein, N1 (the first end; upper limit) is 100 or less. Although not limited, N2 (the second end; lower limit) is e.g. 70. The second control mode is allocated to the first dimming interval. The first dimming state is such a state in which the lower limit (N2%) of the dimming ratio in the first dimming interval is selected.

The second dimming interval is defined as an interval in which the dimming ratio is N3% to N4% (N3>N4). Herein, N3 (the first end; upper limit) is N2 or less (N2>N3). Although not limited, N4 (the second end; lower limit) is e.g. 20. The third control mode is allocated to the second dimming interval. The second dimming state is a state in which the lower limit (N4%) of the dimming ratio in the second dimming interval is selected.

The third dimming interval is defined as an interval in which the dimming ratio is N5% to N6% (N5>N6). Herein, N5 (the first end; upper limit) is N4 or less (N4>N5). Although not limited, N6 (the second end; lower limit) is e.g.

10 or less. The second control mode is again allocated to the third dimming interval. The third dimming state is a state in which the lower limit (N6%) of the dimming ratio in the third dimming interval is selected.

That is, the first dimming state mentioned herein is a lighting state according to the second control mode. The second dimming state is a lighting state in which the third control mode is additionally selected from the first dimming state. The third dimming state is a lighting state in which the second control mode is additionally selected from the second dimming state. That is, the lighting apparatus 1 is transferred to the first dimming state through the second control mode from the full lighting state (from the first control mode). The lighting apparatus 1 is transferred to the second dimming state through the third control mode from the first dimming state. The lighting apparatus 1 is transferred to the third dimming state through the second control mode from the second dimming state. In other words, the first dimming state is a state in which only the second control mode is selected from the full lighting state. The second dimming state is a state in which the third control mode in addition to the second control mode is selected from the full lighting state in a multi-stage type. The third dimming state is a state in which the second control mode is further selected in addition to the selection of the third control mode and the second control mode from the full lighting state in a multi-stage type.

Figure 2:
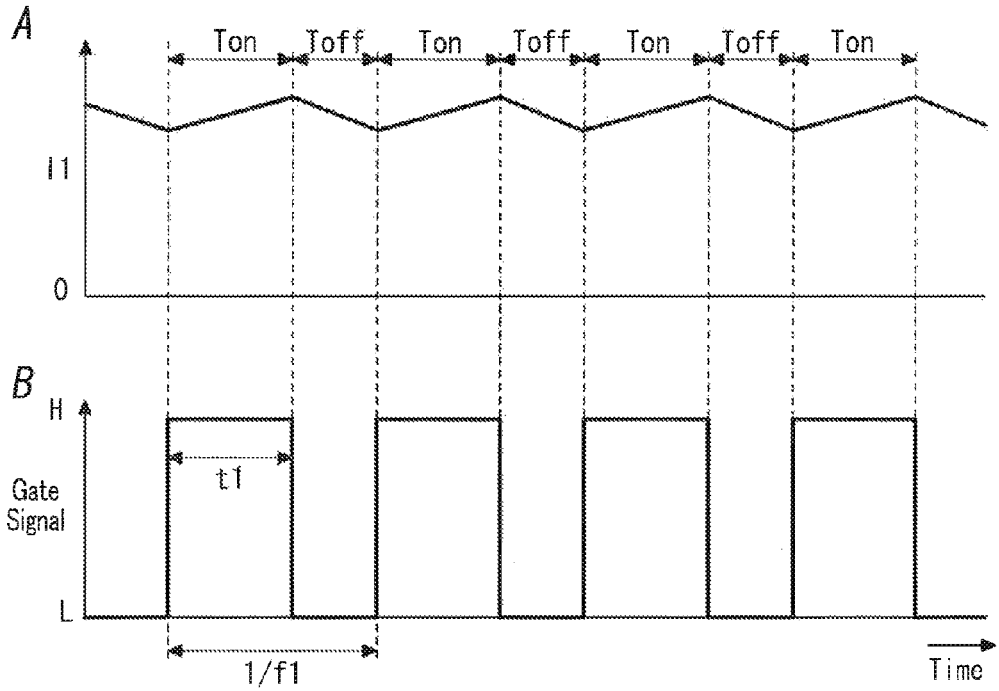
FIGS. 2A and 2B are views for describing the operation of the lighting apparatus in a full lighting state according to the first embodiment.
Figure 3:
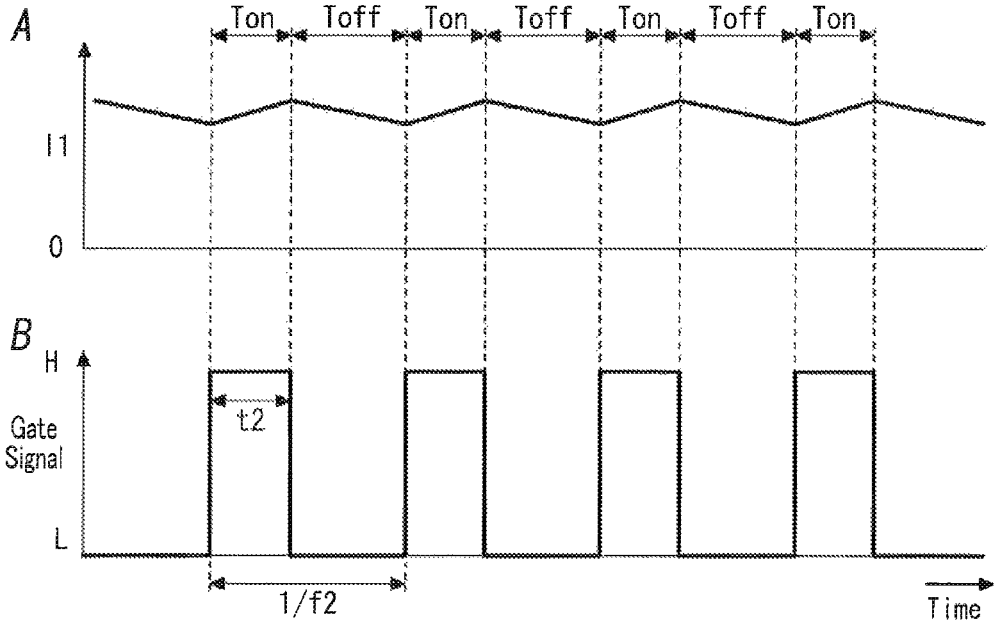
FIGS. 3A and 3B are views for describing the operation of the lighting apparatus in a first dimming state according to the first embodiment.
Figure 4:
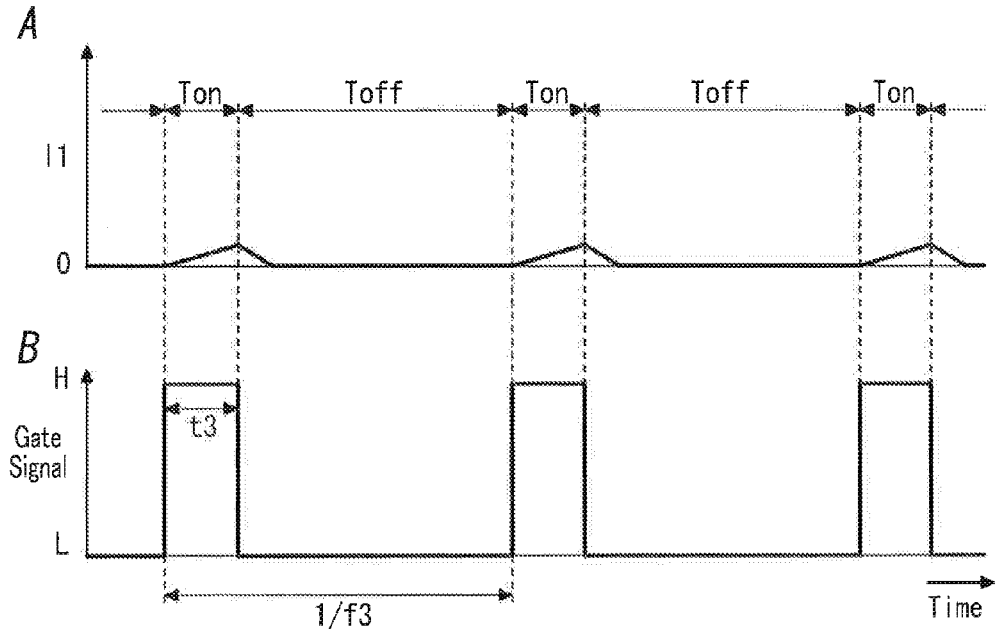
FIGS. 4A and 4B are views for describing the operation of the lighting apparatus in a second dimming state according to the first embodiment.
Figure 5:
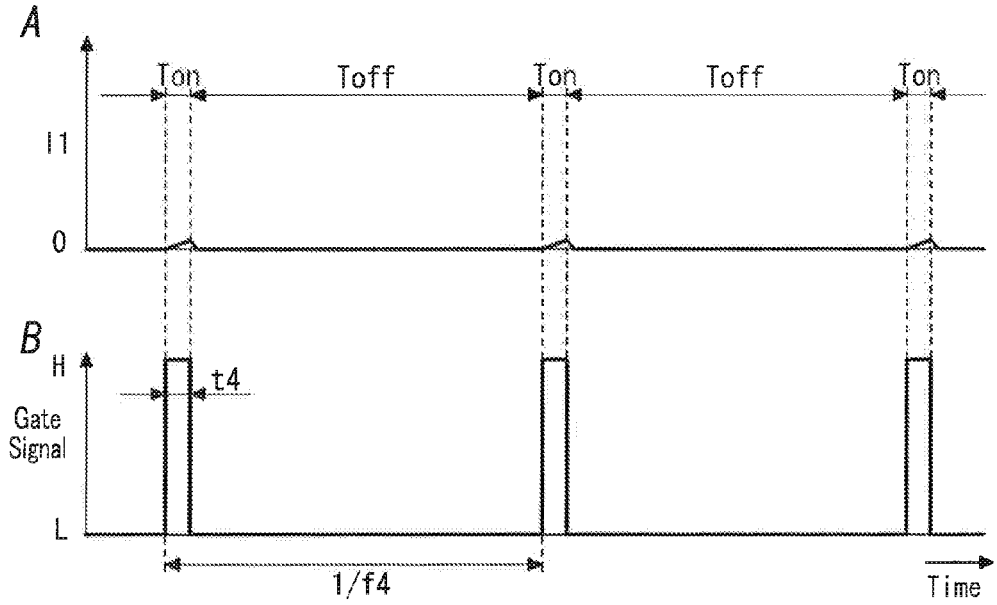
FIGS. 5A and 5B are views for describing the operation of the lighting apparatus in a third dimming state according to the first embodiment.

FIG. 2 shows an operation of the lighting apparatus 1 in the full lighting state. In FIGS. 2A and 2B, each horizontal axis represents time, and FIG. 2A shows a current I1 flowing through the inductor 163, and FIG. 2B shows a gate signal (a driving signal) applied to the gate terminal of the switching element 162 from the control circuit 4 (FIGS. 3 to 5 are the same as FIG. 2). Further, in FIG. 2, an On interval in which the switching element 162 is turned on (that is, a period in which a gate signal is the H level) is represented by "Ton", and an Off interval in which the switching element 162 is turned off (that is, a period in which the gate signal is the L level) is represented by "Toff" (FIGS. 3 to 5 are the same as FIG. 2).

In the On interval of the switching element 162 in the full lighting state, a current flows through a path of the DC power supply circuit 15, the light source load 3, the inductor 163, the switching element 162, and the DC power supply circuit 15 from the DC power supply circuit 15, and thus electromagnetic energy is stored in the inductor 163. Meanwhile, in the Off interval of the switching element 162, the electromagnetic energy stored in the inductor 163 is discharged and a current flows through a path of the inductor 163, the diode 161, the light source load 3, and the inductor 163.

Here, in the full lighting state (mode), the control circuit 4 turns the switching element 162 on and off at the predetermined oscillating frequency and the predetermined On time (On time per one period) according to the first control mode. As shown in FIG. 2A, in the full lighting state, the lighting apparatus 1 is operated in a so-called continuous mode in which, after the switching element 162 is turned off, the switching element 162 is turned on before the current I1 flowing through the inductor 163 becomes zero. In this case, the aforementioned predetermined oscillating frequency of the switching element 162 is f1 and the predetermined On time thereof is t1. Further, in this case, the output current supplied from the lighting apparatus 1 to the light source load 3 is smoothed with the output capacitor 164 so that the ripple ratio (Ipp/Ia) is less than 0.5.

FIGS. 3A and 3B show an operation of the lighting apparatus 1 in the first dimming state.

In the first dimming interval, the control circuit 4 mainly controls the On time of the switching element 162, and an oscillating frequency f2 is approximately equal to the oscillating frequency f1 of the full lighting state. That is, the control circuit 4 changes only the On time of the switching element 162 so as to be short while fixing the oscillating frequency of the switching element 162 from the full lighting state. In the first dimming interval, the control circuit 4 controls the On time of the switching element 162 within a range of t2 to t2' (t2<t2') in accordance with the designated dimming ratio. The On time t2' corresponds to the maximum dimming ratio (N1) of the first dimming interval, and t2' preferably equals to t1. The On time t2 corresponds to the minimum dimming ratio (N2) of the first dimming interval. The first dimming state corresponds to a state in which the On time is set at t2. Here, as shown in FIG. 3A, even in the first dimming state, the lighting apparatus 1 is operated in a so-called continuous mode in which, after the switching element 162 is turned off, the switching element 162 is turned on before the current I1 flowing through the inductor 163 becomes zero.

As such, when the lighting apparatus 1 is in the first dimming state (in the first dimming interval), since the On time of the switching element 162 is short, a peak of the current I1 flowing through the inductor 163 is reduced and the electromagnetic energy stored in the inductor 163 is also reduced, as compared to the full lighting state. As a result, when compared with the full lighting state, the current (the output current) supplied from the lighting apparatus 1 to the light source load 3 is reduced and the light output from the light source load 3 is reduced (becomes dark). In this case, the On time t2 of the switching element 162 is shorter than the On time t1 in the full lighting state (t1>t2) and the oscillating frequency f2 is approximately the same as the oscillating frequency f1 of the full lighting state (f1≈f2).

FIGS. 4A and 4B show an operation of the lighting apparatus 1 in the second dimming state.

In the second dimming interval, the control circuit 4 mainly controls the oscillating frequency of the switching element 162, and the On time t3 is approximately the same as the On time t2 of the first dimming state. That is, the control circuit 4 changes only the oscillating frequency of the switching element 162 so as to be reduced while fixing the On time of the switching element 162 from the first dimming state. In the second dimming interval, the control circuit 4 controls the oscillating frequency of the switching element 162 within a range of f3 to f3' (f3<f3') in accordance with the designated dimming ratio. The oscillating frequency f3' corresponds to the maximum dimming ratio (N3) of the second dimming interval, and f3' preferably equals to f2. The oscillating frequency f3 corresponds to the minimum dimming ratio (N4) of the second dimming interval. The second dimming state corresponds to a state in which the oscillating frequency is set at f3. Here, as shown in FIG. 4A, in the present embodiment, the lighting apparatus 1 is shifted from the continuous mode in which the current I1 continuously flows through the inductor 163 into a discontinuous mode in which the current I1 intermittently flows through the inductor 163 in the second dimming interval. That is, the lighting apparatus 1 is shifted from the continuous mode into the discontinuous mode in a dimming interval to which the third control mode is allocated.

As such, when the lighting apparatus 1 is in the second dimming state (in the second dimming interval), the oscillating frequency of the switching element 162 is reduced and the Off time (the Off time per one period) of the switching element 162 is long accordingly. Therefore, when the lighting apparatus 1 is in the second dimming state, the peak of the current I1 flowing through the inductor 163 is reduced more and the electromagnetic energy stored in the inductor 163 is also reduced more, as compared to the first dimming state. As a result, when compared with the first dimming state, the current (the output current) supplied from the lighting apparatus 1 to the light source load 3 is reduced more and the light output from the light source load 3 is reduced more (becomes darker). In this case, the On time t3 of the switching element 162 is approximately the same as the On time t2 of the first dimming state (t2≈t3) and an oscillating frequency f3 is lower than the oscillating frequency f2 of the first dimming state (f2>f3).

FIGS. 5A and 5B show an operation of the lighting apparatus 1 in the third dimming state.

In the third dimming interval, the control circuit 4 mainly controls the On time of the switching element 162, and an oscillating frequency f4 is approximately equal to the oscillating frequency f3 of the second dimming state. That is, the control circuit 4 changes only the On time of the switching element 162 so as to be short while fixing the oscillating frequency of the switching element 162 from the second dimming state. In the third dimming interval, the control circuit 4 controls the On time of the switching element 162 within a range of t4 to t4' (t4<t4') in accordance with the designated dimming ratio. The On time t4' corresponds to the maximum dimming ratio (N5) of the third dimming interval, and t4' preferably equals to t3. The On time t4 corresponds to the minimum dimming ratio (N6) of the third dimming interval. The third dimming state corresponds to a state in which the On time is set at t4.

As such, when the lighting apparatus 1 is in the third dimming state (in the third dimming interval), since the On time of the switching element 162 is shorter, the peak of the current I1 flowing through the inductor 163 is reduced more and the electromagnetic energy stored in the inductor 163 is also reduced more, as compared to the second dimming state. As a result, when compared with the second dimming state, the current (the output current) supplied from the lighting apparatus 1 to the light source load 3 is reduced more and the light output from the light source load 3 is reduced more (becomes darker). In this case, the On time t4 of the switching element 162 is shorter than the On time t3 of the second dimming state (t3>t4) and the oscillating frequency f4 is approximately the same as the oscillating frequency f3 of the second dimming state (f3≈f4).

Consequently, the light source load 3 is brightest in the full lighting state and is darkest in the third dimming state.

The present embodiment illustrates the case in which the control circuit 4 continuously changes the On time of the switching element 162 in the second control mode and the oscillating frequency of the switching element 162 is continuously changed in the third control mode. However, the present embodiment is not limited to the example. For example, the control circuit 4 may change the On time of the switching element 162 stepwise (discontinuously) in the second control mode and may change the oscillating frequency of the switching element 162 stepwise (discontinuously) in the third control mode.

Next, a detailed configuration of the control circuit 4 will be described in more detail.

In the present embodiment, the driver circuit 4A of the control circuit 4 includes an integrated circuit (IC) 40 for control and peripheral components thereof as shown in FIG. 6. As the integrated circuit 40, "L6562" from ST Micro Electronic Co. is used herein. The integrated circuit (L6562) 40 is an original IC for controlling a PFC circuit (step-up chopper circuit for power factor improving control) and includes components unnecessary to control the step-down chopper circuit 16 therein, such as a multiplying circuit. On the other hand, the integrated circuit 40 includes a function of controlling a peak value of an input current and a function of controlling zero cross within one chip in order to control so that the average value of the input current becomes a similar figure to an envelope of an input voltage, and uses these functions for controlling the step-down chopper circuit 16.

The lighting apparatus 1 includes a control power supply circuit 7 that has a zener diode 701 and a smoothing capacitor 702. The control power supply circuit 7 is adapted to supply control power to the integrated circuit 40. The lighting apparatus 1 is adapted to apply an output voltage of the control power supply circuit 7 to a power supply terminal (an eighth pin P8) of the integrated circuit 40.

Figure 7:
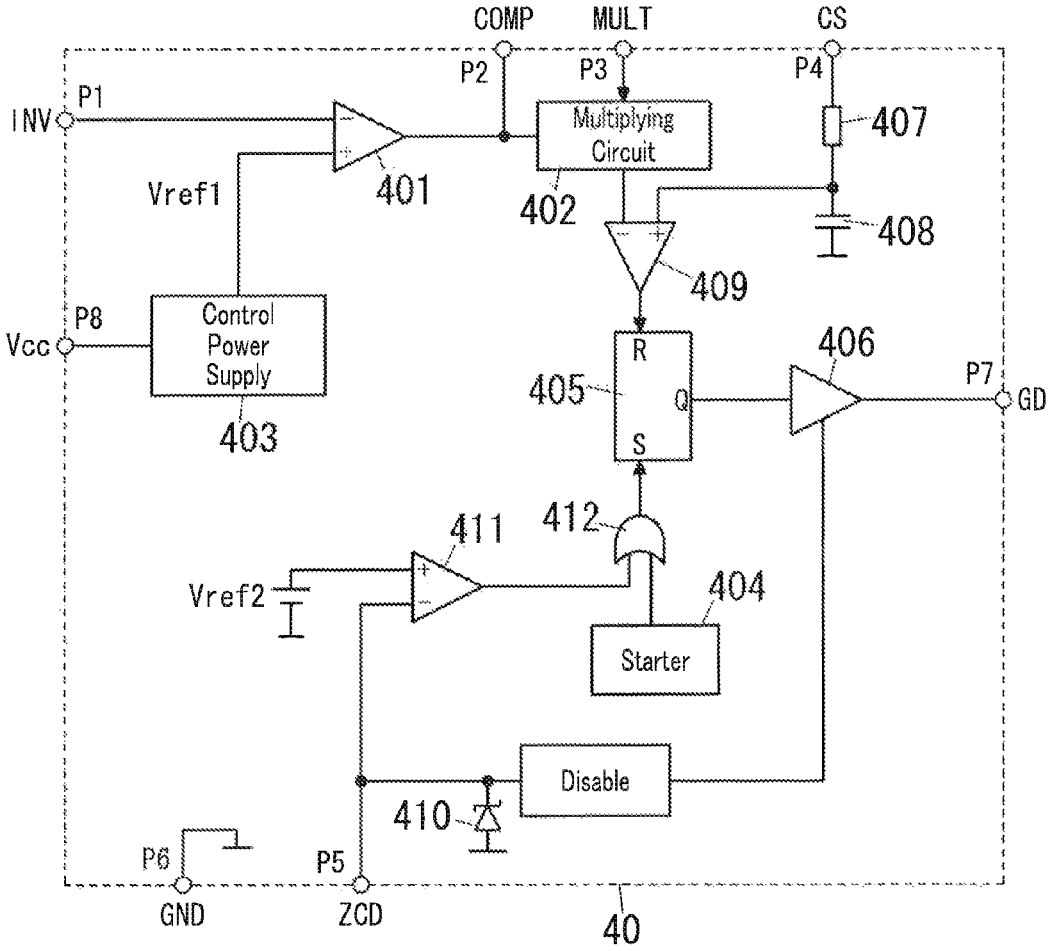
FIG. 7 is a circuit diagram showing the configuration of a control circuit of the lighting apparatus according to the first embodiment.

FIG. 7 schematically shows an internal configuration of the integrated circuit 40 used in the present embodiment. The first Pin (INV) P1 is an inverting input terminal of a built-in error amplifier 401 of the integrated circuit 40, the second pin (COMP) P2 is an output terminal of the error amplifier 401. The third pin (MULT) P3 is an input terminal of a built-in multiplying circuit 402 of the integrated circuit 40. The fourth Pin (CS) P4 is a chopper current detection terminal, the fifth pin (ZCD) P5 is a zero cross detection terminal, the sixth pin (GND) P6 is a ground terminal, the seventh pin (GD) P7 is a gate drive terminal, and the eighth pin (Vcc) P8 is a power supply terminal.

When control power supply voltage of a predetermined voltage or more is applied between the eighth and sixth pins P8 and P6, reference voltages Vref1 and Vref2 are generated with a control power supply 403, and thus each circuit in the integrated circuit 40 can be operated. When power is applied to the integrated circuit 40, a start pulse is supplied to a set input terminal ("S" in FIG. 7) of a flip flop 405 through a starter 404, an output ("Q" in FIG. 7) of the flip flop 405 becomes the H level, and the seventh pin P7 becomes the H level through a driving circuit 406.

When the seventh pin P7 becomes the H level, a drive voltage (a gate signal) divided by the resistors 41 and 42 shown in FIG. 6 is applied between the gate and the source of the switching element 162. A resistor 43 inserted between a source terminal of the switching element 162 and a negative electrode of the DC power supply circuit 15 is a small resistor for detecting (measuring) a current flowing through the switching element 162 and hardly affects the driving voltage between the gate and the source.

When the switching element 162 is supplied with the drive voltage and then turned on, a current flows to a negative electrode of the smoothing capacitor 152 through the output capacitor 164, the inductor 163, the switching element 162, and the resistor 43 from a positive electrode of the smoothing capacitor 152. In this case, a chopper current flowing through the inductor 163 is an approximately linearly increasing current unless the inductor 163 is magnetic-saturated, and is detected by the resistor 43 as a current sensing unit. A serial circuit of a resistor 44 and a capacitor 62 is connected between both ends of the (current sensing) resistor 43. A connection point between the resistor 44 and the capacitor 62 is connected to the fourth pin P4 of the integrated circuit 40. Therefore, a voltage corresponding to the current value sensed through the resistor 43 is supplied to the fourth pin P4 of the integrated circuit 40.

A voltage value supplied to the fourth pin P4 of the integrated circuit 40 is applied to a "+" input terminal of a comparator 409 through a noise filter including a resistor 407 and a capacitor 408 therein. A reference voltage determined by the applied voltage to the first pin P1 and the applied voltage to the third pin P3 is applied to a "−" input terminal of the comparator 409, and the output of the comparator 409 is supplied to a reset terminal ("R" in FIG. 7) of the flip flop 405.

In the aforementioned noise filter, the resistor 407 is, for example, 40 kΩ and the capacitor 408 is, for example, 5 pF.

Therefore, if the voltage of the fourth pin P4 of the integrated circuit 40 exceeds the reference voltage, the output of the comparator 409 becomes the H level and the reset signal is supplied to the reset terminal of the flip flop 405, and thus the output of the flip flop 405 becomes the L level. In this case, the seventh pin P7 of the integrated circuit 40 becomes the L level, and therefore the diode 45 of FIG. 6 is turned on, an electric charge between the gate and the source of the switching element 162 is extracted through a resistor 46, and thereby the switching element 162 is quickly turned off. When the switching element 162 is turned off, the electromagnetic energy stored in the inductor 163 is discharged to the light source load 3 through the diode 161.

In the present embodiment, resistors 47, 48, and 49 and capacitors 50 and 51 average a rectangular wave signal S1 supplied from a signal generation circuit 21 (see FIG. 8; to be described below), and therefore a voltage having a size according to a duty ratio of the rectangular wave signal S1 is applied to the third pin P3. Therefore, the reference voltage across the comparator 409 is changed according to the duty ratio of the rectangular wave signal 51. Here, when the duty ratio of the rectangular wave signal S1 is large (when the time of the H level is long), the reference voltage is large and therefore, the On time of the switching element 162 is long. Meanwhile, when the duty ratio of the rectangular wave signal S1 is small (when the time of the H level is short), the reference voltage is small, and therefore the On time of the switching element 162 is short.

In other words, the control circuit 4 turns the switching element 162 off when a value of the current sensed (measured) through the resistor (the current sensing unit) 43 reaches a predetermined first value (corresponding to the reference voltage) determined by the rectangular wave signal S1. The On time of the switching element 162 is changed by changing the first value. Therefore, in the embodiment of the present invention, the On time of the switching element 162 can be changed using this principle in the first dimming interval and the third dimming interval.

As shown in FIG. 6, the Off time of the switching element 162 is determined by: a series circuit of the diode 52 and the resistor 53, connected between the seventh and fifth pins P7 and P5 of the integrated circuit 40; the capacitor 54 connected in parallel with the resistor 53; a capacitor 55; a transistor 56; and a resistor 57. The capacitor 55 is connected between the fifth pin P5 and ground. The transistor 56 and the resistor 57 are connected in series with each other and are connected in parallel with the capacitor 55. Here, resistors 58, 59, and 60 and a capacitor 61 average a rectangular wave signal S2 supplied from the signal generation circuit 21 (see FIG. 8; to be described below), and therefore a voltage having a size according to a duty ratio of the rectangular wave signal S2 is applied between a base and an emitter of the transistor 56.

The integrated circuit 40 includes a built-in clamp circuit 410 connected to the fifth pin P5 as shown in FIG. 7, wherein the fifth pin P5 is clamped to a maximum of, e.g., 5.7 V. An output of a comparator 411 of which the "−" input terminal is connected to the fifth pin P5 becomes the H level when the input voltage of the fifth pin P5 is the reference voltage Vref2 (herein, 0.7 V) or less. Therefore, when the seventh pin P7 is the H level (generally about 10 to 15 V), the fifth pin P5 is clamped to 5.7 V. When the seventh pin P7 is the L level, the diode 52 is turned off and the capacitor 55 is discharged up to 0.7 V through the transistor 56 and the resistor 57.

At this time, the output of the comparator 411 becomes the H level. Therefore, the flip flop 405 connected to the output terminal of the comparator 411 through an OR circuit 412 is set, and the output of the flip flop 405 also becomes the H level. Therefore, the seventh pin P7 becomes the H level again, and thus the switching element 162 is turned on. Thereafter, the control circuit 4 repeatedly performs the same operations, and thus the switching element 162 is turned on and off at a high frequency.

Here, as the duty ratio of the rectangular wave signal S2 is larger (as the time of the H level is longer), the voltage between the base and the emitter of the transistor 56 is more increased and a current flowing through the transistor 56 is also more increased. Therefore, the capacitor 55 is more quickly discharged. Therefore, the Off time of the switching element 162 becomes shorter and the oscillating frequency of the switching element 162 is increased. On the other hand, as the duty ratio of the rectangular wave signal S2 is smaller (as the time of the H level is shorter), the voltage between the base and the emitter of the transistor 56 is more reduced and the current flowing through the transistor 56 is also more reduced. Accordingly, the discharge of the capacitor 55 is delayed. Therefore, the Off time of the switching element 162 becomes longer and the oscillating frequency of the switching element 162 is reduced.

In other words, the control circuit 4 turns the switching element 162 on when a value of the voltage across the capacitor 55 charged by the driving signal of the switching element becomes a predetermined threshold value (a value of the reference voltage Vref2) or less. Here, the control circuit 4 determines a discharge speed of the capacitor 55 based on a predetermined second value (the voltage between the base and the emitter of the transistor 56) determined by the rectangular wave signal S2, and changes the predetermined second value to change the oscillating frequency of the switching element 162. Therefore, in the second dimming interval of the present embodiment, the oscillating frequency of the switching element 162 can be changed using this principle.

Figure 8:
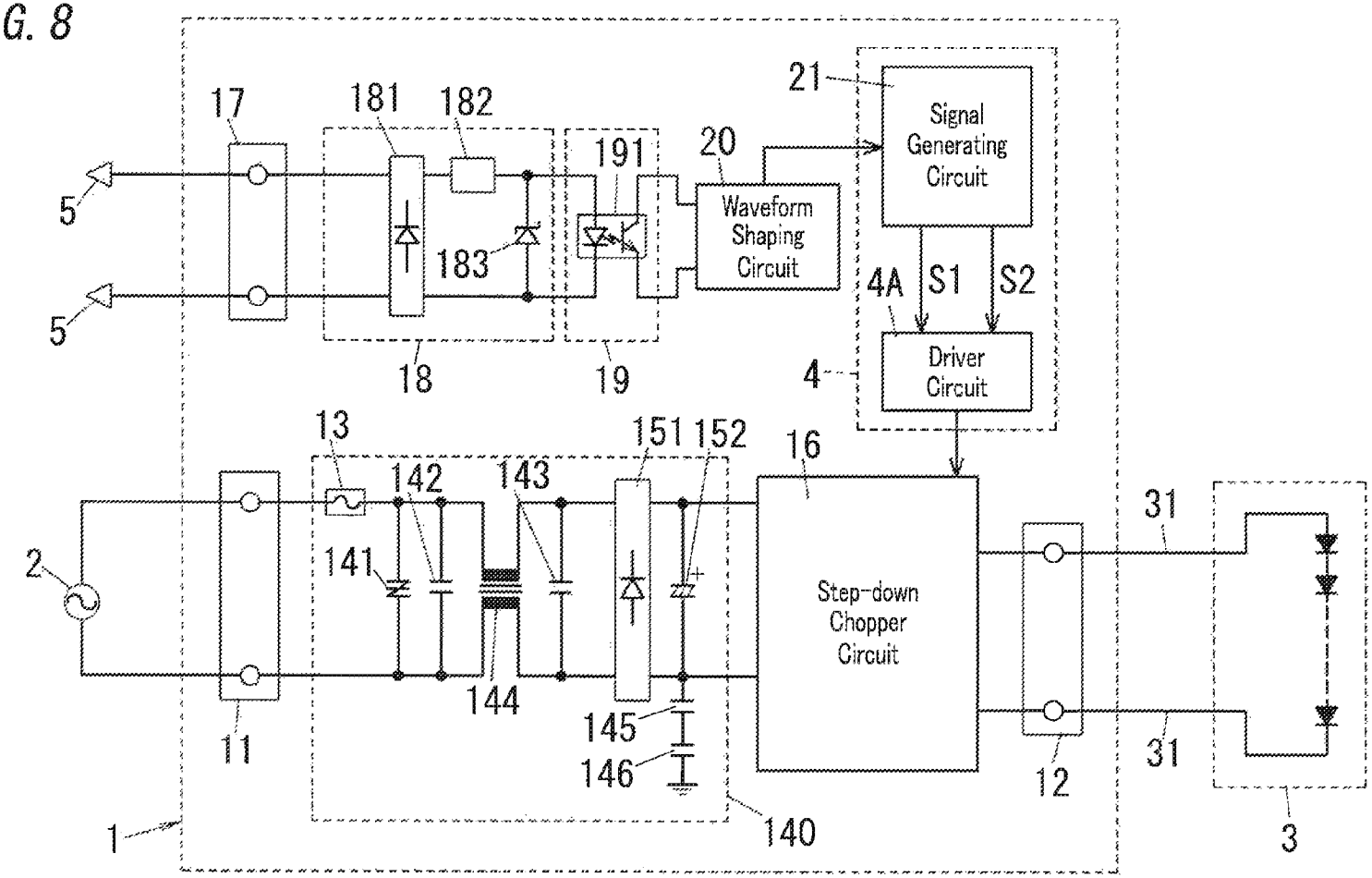
FIG. 8 is a circuit diagram showing the configuration of the lighting apparatus according to the first embodiment.

Next, the overall configuration of the lighting apparatus 1 in which the lighting apparatus 1 shown in FIG. 1 or 6 is added with a component receiving a dimming signal for determining the dimming ratio to generate the rectangular wave signals S1 and S2 will be described with reference to FIG. 8. FIG. 8 shows a DC power supply generation unit 140 in which the foregoing filter circuit 14 and the DC power supply circuit 15 are combined, and capacitors 145 and 146 in the DC power supply generating unit 140 connect a circuit ground (the negative electrode of the capacitor 152) to a frame ground in high frequency.

In FIG. 8, the lighting apparatus 1 includes a signal line connector 17 for connecting a dimming signal line 5, a rectifying circuit 18, an insulating circuit 19, and a waveform shaping circuit 20, in addition to the components shown in FIG. 1 or 6. The control circuit 4 includes the signal generating circuit 21, in addition to the driver circuit 4A. The dimming signal line 5 is supplied with the dimming signal including a rectangular wave voltage signal, wherein the duty ratio of the rectangular wave voltage signal is variable, and the frequency and amplitude of the rectangular wave voltage signal are, for example, 1 kHz and 10 V, respectively.

The rectifying circuit 18 is a circuit for converting wires of the dimming signal line 5 into non-polarized wires. The rectifying circuit 18 is connected to the signal line connector 17. The lighting apparatus 1 includes the rectifying circuit 18, and thus is normally operated even when the dimming signal line 5 is connected thereto reversely. That is, the rectifying circuit 18 includes: a full-wave rectifier 181 connected to the signal line connector 17; and a series circuit of a zener diode 183 and an impedance element 182 such as a resistor, connected in series between outputs of the full-wave rectifier 181. Therefore, the rectifying circuit 18 full-wave rectifies the input dimming signal with the full-wave rectifier 181 and generates a rectangular wave voltage signal across the zener diode 183 through the impedance element 182.

The insulating circuit 19 includes a photocoupler 191, and serves to transfer the rectangular wave voltage signal to the control circuit 4 while insulating the dimming signal line 5 and the control circuit 4 of the lighting apparatus 1. The waveform shaping circuit 20 is adapted to shape a waveform of a signal output from the photocoupler 191 of the insulating circuit 19 so as to be output as a pulse width modulation (PWM) signal. Therefore, although the waveform of the rectangular wave voltage signal (the dimming signal) may be distorted because transmitted in a long distance through the dimming signal line 5, the influence of the distortion is removed through the waveform shaping circuit 20.

Here, in a conventional inverter-type fluorescent lamp dimming ballast, a low pass filter circuit such as a CR integrating circuit (a smoothing circuit) is mounted at a latter stage of the waveform shaping circuit. The ballast is adapted to generate an analog dimming voltage and variably control a frequency of the inverter, and the like, according to the dimming voltage. In contrast, the lighting apparatus 1 according to the present embodiment is adapted to supply a PWM signal after the waveform shaping to the signal generation circuit 21.

The signal generation circuit 21 of the control circuit 4 includes a microcomputer and peripheral components thereof, which are not shown. The microcomputer is configured to measure an On time of the input PWM signal through a built-in timer, and supply two kinds of rectangular wave signals S1 and S2 to the driver circuit 4A. The rectangular wave signals S1 and S2 supplied from the microcomputer are smoothed through the resistors and the capacitors within the driver circuit 4A, as described above. Therefore, as the duty ratio of the rectangular wave signal S1 (or S2) is larger (as the time of the H level is longer), the input value in the driver circuit 4A is more increased. That is, as the duty ratio of the rectangular wave signal S1 is larger, the voltage V1 of the third pin P3 supplied with the smoothed rectangular wave signal S1 is more increased. As the duty ratio of the rectangular wave signal S2 is larger, the voltage V2 between the base and the emitter of the transistor 56, supplied with the smoothed rectangular wave signal S2, is more increased.

Figure 9:
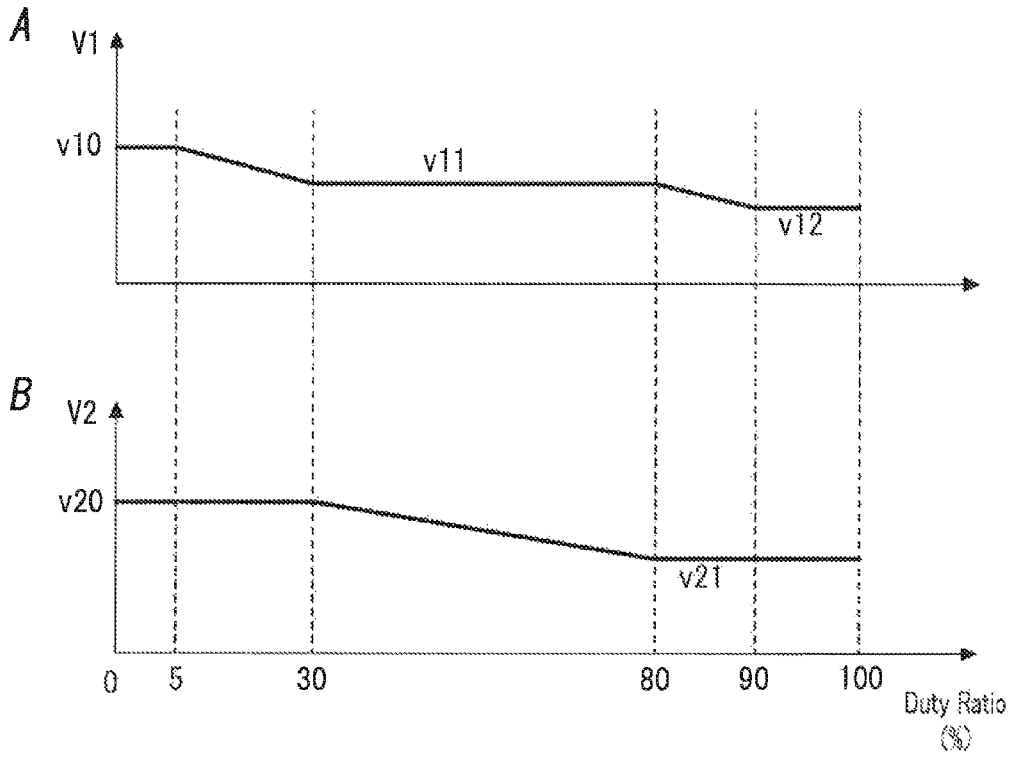
FIGS. 9A and 9B are views for describing the operation of the lighting apparatus according to the first embodiment.

Next, an operation of the lighting apparatus 1 when the PWM signal is changed will be described with reference to FIG. 9. In FIGS. 9A and 9B, each horizontal axes represents the duty ratio (On duty) of the PWM signal, FIG. 9A shows the voltage V1 applied to the third pin P3 of the integrated circuit 40 of the driver circuit 4A, and FIG. 9B shows the voltage V2 between the base and the emitter of the transistor 56. The duty ratio of the PWM signal corresponds to the duty ratio of the dimming signal because, for the PWM signal, the dimming signal is subjected to only the rectifying or the waveform shaping.

The first control mode is allocated for an interval in which a duty ratio of the PWM signal is in a range of 0 to 5% (a first interval), where 0% is a first end of the first interval, and 5% is a second end of the first interval. As shown in FIGS. 9A and 9B, in the interval in which the duty ratio of the PWM signal is in a range of 0 to 5%, the voltage V1 of the third pin P3 and the voltage V2 between the base and the emitter of the transistor 56 are set as initial values (V1=v10, V2=v20), respectively. Therefore, in this interval, the lighting apparatus 1 is in the full lighting state (in the first control mode) and the oscillating frequency of the switching element 162 of the step-down chopper circuit 16 is f1 and the On time is t1.

The second control mode is allocated for an interval in which a duty ratio of the PWM signal is in a range of 5 to 30% (a second interval), where 5% is a first end of the second interval, and 30% is a second end of the second interval. This second interval corresponds to the first dimming interval of the dimming range. In this interval, the signal generation circuit 21 reduces the duty ratio of the rectangular wave signal S1 according to the increase in the duty ratio of the PWM signal to reduce the voltage V1 of the third pin P3 up to v11 (<v10). When the voltage V1 is reduced, the On time of the switching element 162 becomes shorter, and thus the load current (the output current supplied to the light source load 3) is reduced. In this case, in order to substantially maintain the oscillating frequency of the switching element 162 constant, the signal generation circuit 21 can be adapted to slightly reduce the duty ratio of the rectangular wave signal S2 in accordance with the reduction of the voltage V1, thereby slightly reduces the voltage V2 and delays the discharge of the capacitor 55 to slightly increase the Off time of the switching element 162.

The third control mode is allocated for an interval in which a duty ratio of the PWM signal is in a range of 30 to 80% (a third interval), where 30% is a first end of the third interval, and 80% is a second end of the third interval. This third interval corresponds to the second dimming interval of the dimming range. In this interval, the signal generation circuit 21 reduces the duty ratio of the rectangular wave signal S2 according to the increase in the duty ratio of the PWM signal, thereby reducing the voltage V2 between the base and the emitter up to v21 (<v20). When the voltage V2 is reduced, drawn current of the transistor 56 is reduced and discharging time of the capacitor 55 is increased so that the Off time of the switching element 162 becomes longer and the oscillating frequency is reduced, such that the load current (the output current) is reduced. In this case, the value of the voltage V1 of the third pin P3 is maintained at v11, and therefore the On time of the switching element 162 is constant.

The second control mode is allocated for an interval in which a duty ratio of the PWM signal is in a range of 80 to 90% (a fourth interval), where 80% is a first end of the fourth interval, and 90% is a second end of the fourth interval. This fourth interval corresponds to the third dimming interval of the dimming range. In this interval, the signal generation circuit 21 reduces the duty ratio of the rectangular wave signal S1 according to the increase in the duty ratio of the PWM signal, thereby reducing the voltage V1 of the third pin P3 up to v12 (<v11). When the voltage V1 is reduced, the On time of the switching element 162 becomes shorter, and thus the load current (the output current) is reduced more. In this case, in order to substantially maintain the oscillating frequency of the switching element 162 constant, the signal generation circuit 21 can be adapted to slightly reduce the duty ratio of the rectangular wave signal S2 in accordance with the reduction of the voltage V1, thereby slightly reduces the voltage V2 and delays the discharge of the capacitor 55 to slightly increase the Off time of the switching element 162.

In an interval in which a duty ratio of the PWM signal is in a range of 90 to 100% (a fifth interval), the signal generation circuit 21 is set to constantly maintain the duty ratios of the rectangular wave signals S1 and S2, thereby maintaining the third dimming state. Alternatively, in the interval in which the duty ratio of the PWM signal is in a range of 90% to 100%, the lighting apparatus 1 may set at least one of the voltage V1 of the third pin P3 and the voltage V2 between the base and the emitter to the L level to stop the operation of the step-down chopper circuit 16 and turn the light source load 3 off. That is, the control circuit 4 can be adapted to set at least one of a predetermined first value (corresponding to the reference voltage) determined by the rectangular wave signal S1 and a predetermined second value (the voltage V2 between the base and the emitter) determined by the rectangular wave signal S2 to zero or less, thereby stops the On and Off operation of the switching element 162.

The control circuit 4 sets the oscillating frequency of the switching element 162 to be in a range of 1 kHz or more, preferably, several kHz or more. Therefore, even in the second or third dimming state in which the oscillating frequency is reduced, a flicker frequency of the light source load 3 is high, and, for example, the interference between the flicker of the light source load 3 and the shutter speed (the exposure time) at the time of the camera photographing can be avoided.

According to the lighting apparatus 1 of the present embodiment as described above, the control circuit 4 randomly selects the second control mode for changing the On time of the switching element 162 and the third control mode for changing the oscillating frequency in a multi stage, thereby dimming the light source load 3. Therefore, when comparing with the case in which the light source load 3 is dimmed based on only the second control mode or the third control mode, the lighting apparatus 1 can expand the dimming range of the light source load 3 without flickering the light source load 3. As a result, the lighting apparatus 1 can precisely (finely) control the brightness of the light source load 3 over the relatively wide range.

In addition, the control of the dimming ratio in the dimming state is performed through the signal generation circuit 21 including the microcomputer as a main component, such that the lighting apparatus 1 that can precisely (finely) control the brightness of the light source load 3 with the relatively simple configuration can be realized.

Further, the output current supplied to the light source load 3 is smoothed with the output capacitor 164 and the ripple ratio of the output current is set to be less than 0.5 at the time of the full lighting of the light source load 3, such that the lighting apparatus 1 having the foregoing configuration suppresses the flicker of the light source load 3, thereby increasing the light emitting efficiency.

In the present embodiment, the dimming signal supplied to the lighting apparatus 1 is the rectangular wave of which the duty ratio varies, but it is not limited thereto. For example, the dimming signal may be a DC voltage of which the voltage value varies. In this case, the signal generation circuit 21 including the microcomputer realizes the dimming control by controlling the duty ratios of the rectangular wave signals S1 and S2 based on the amplitude (the voltage value) of the dimming signal. The lighting apparatus 1 is not limited as a configuration that the dimming signal is input through the dimming signal line 5. For example, the lighting apparatus 1 may be a configuration in which an infrared light receiving module is mounted to receive the dimming signal by infrared communication.

(Second Embodiment)

Figure 10:
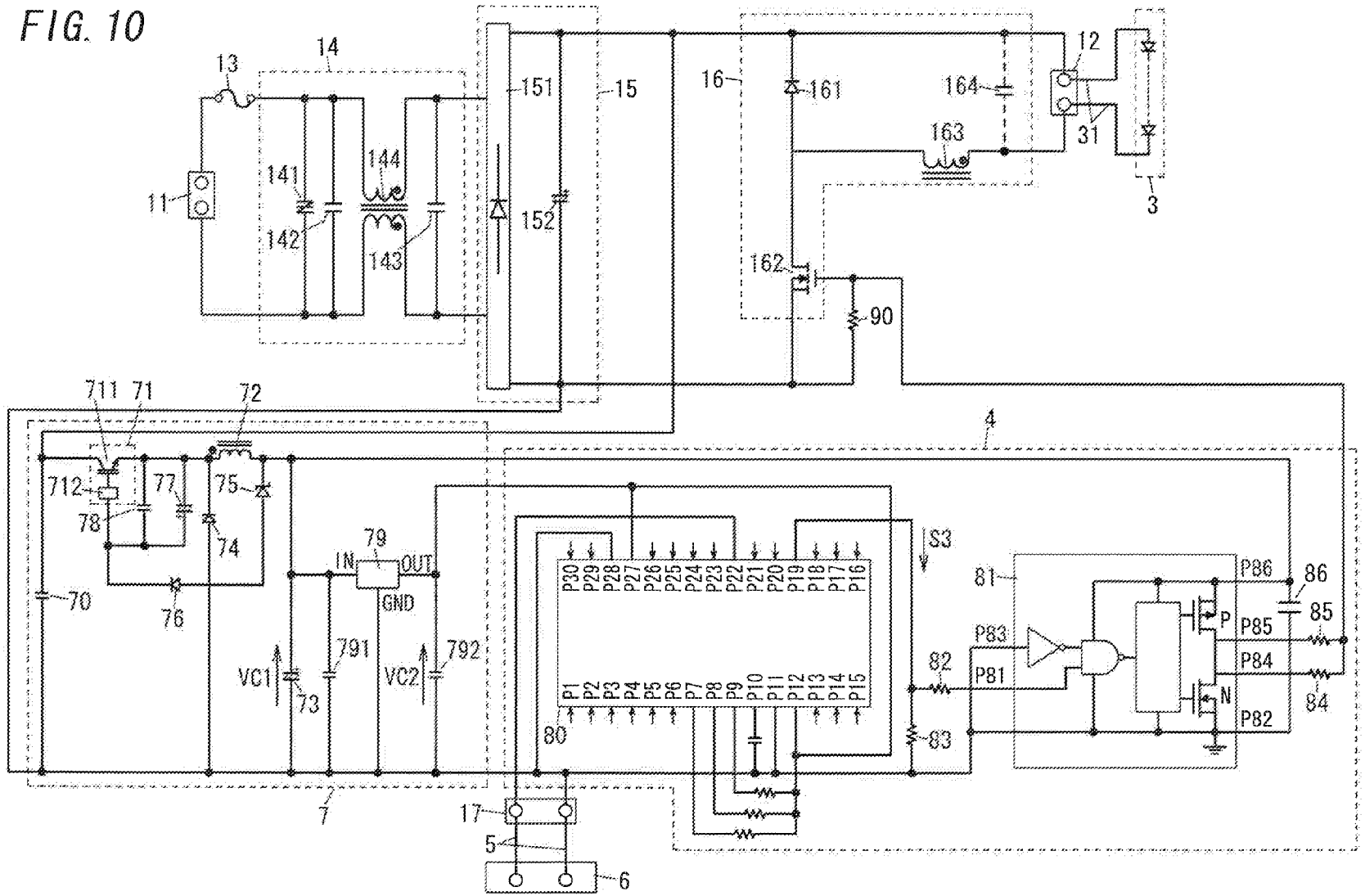
FIG. 10 is a circuit diagram showing the configuration of a lighting apparatus according to a second embodiment of the present invention.

The lighting apparatus 1 according to the present embodiment is different from the lighting apparatus 1 according to the first embodiment in terms of the configuration of the control circuit 4 and the control power supply circuit 7, as shown in FIG. 10. In the example of FIG. 10, an external dimmer 6 outputting the rectangular wave voltage signal of 5 V, 1 kHz as the dimming signal is connected to the signal line connector 17 of the lighting apparatus 1 through the dimming signal line 5. Hereinafter, the same components as in the first embodiment are denoted by the same reference numerals and the description thereof will not be repeated here.

As shown in FIG. 10, in the present embodiment, the control power supply circuit 7 includes an IPD element 71 connected to the smoothing capacitor 152, and peripheral components thereof. The IPD element 71 is a so-called intelligent power device and for example, "MIP2E2D" from Panasonic is used for the element. The IPD element 71, which is a three-pin integrated circuit having a drain terminal, a source terminal, and a control terminal. The IPD element 71 includes a built-in switching element 711 including a power MOSFET and a built-in controller 712 adapted to turn the switching element 711 on and off. In the control power supply circuit 7, a step-down chopper circuit is constituted mainly by the built-in switching element 711 in the IPD device 71, an inductor 72, a smoothing capacitor 73, and a diode 74. In the control power supply circuit 7, a power supply circuit of the IPD element 71 is constituted mainly by a zener diode 75, a diode 76, a smoothing capacitor 77, and a capacitor 78. A capacitor 70 for noise cut is connected to the drain terminal of the IPD element 71.

By the above configuration, the control power supply circuit 7 generates a constant voltage (for example, about 15 V) across the smoothing capacitor 73, wherein the constant voltage is a power supply voltage VC1 for supplying the control power of integrated circuits (a three-terminal regulator 79, a microcomputer 80, and a driver circuit 81). Therefore, because the smoothing capacitor 73 is uncharged until the IPD element 71 starts operation, other integrated circuits (the three-terminal regulator 79, the microcomputer 80, and the driver circuit 81) are not operated.

Hereinafter, an operation of the control power supply circuit 7 will be described.

At the early stage of power up, when the smoothing capacitor 152 is charged by the output voltage of the full-wave rectifier 151, a current flows along a path of the drain terminal of the IPD element 71, the control terminal of the IPD element 71, the smoothing capacitor 77, the inductor 72, and the smoothing capacitor 73. Therefore, the smoothing capacitor 73 is charged with the polarity as shown in FIG. 10 and supplies an operating voltage to the IPD element 71. Therefore, the IPD element 71 is activated and turns the built-in switching element 711 on and off When the built-in switching element 711 of the IPD element 71 is turned on, a current flows along a path of the smoothing capacitor 152, the drain terminal of the IPD element 71, the source terminal of the IPD element 71, the inductor 72 and the smoothing capacitor 73, and thus the smoothing capacitor 73 is charged. When the switching element 711 is turned off, the electromagnetic energy stored in the inductor 72 is discharged to the smoothing capacitor 73 through the diode 74. Therefore, the circuit including the IPD element 71, the inductor 72, the diode 74, and the smoothing capacitor 73 is operated as the step-down chopper circuit, such that the power supply voltage VC1 obtained by stepping down the voltage across the smoothing capacitor 152 is generated across the smoothing capacitor 73.

When the built-in switching element 711 in the IPD element 71 is turned off, a regenerative current flows through the diode 74. Voltage across the inductor 72 is clamped to a sum voltage of voltage across the smoothing capacitor 73 and forward voltage of the diode 74. Voltage obtained by subtracting zener voltage of the zener diode 75 and forward voltage of the diode 76 from the sum voltage becomes a voltage across the smoothing capacitor 77. A built-in controller 712 in the IPD element 71 is adapted to control the On and Off operation of the switching element 711 so that the voltage across the smoothing capacitor 77 is constant. As a result, the voltage (the power supply voltage VC1) across the smoothing capacitor 73 is also constant.

When the power supply voltage VC1 is generated across the smoothing capacitor 73, the three-terminal regulator 79 starts a power supply voltage VC2 (for example, 5 V) to the microcomputer 80 to start the On and Off control of the switching element 162 of the step-down chopper circuit 16. The microcomputer 80 is supplied with the dimming signal from the external dimmer 6 and performs the dimming control.

As shown in FIG. 10, the control circuit 4 includes the microcomputer 80 and is configured to generate the rectangular wave signal for driving the switching element 162 of the step-down chopper circuit 16 based on internal programs. The microcomputer 80 has programs set to output a rectangular wave signal S3 (for example, amplitude of 5V) for driving the switching element 162 from the nineteenth pin P19 according to the On time (the pulse width) of the dimming signal from the external dimmer 6 supplied to the twenty-second pin P22. Further, the control circuit 4 includes the driver circuit 81 that receives the output (the rectangular wave signal S3) from the nineteenth pin P19 of the microcomputer 80 to actually drive the switching element 162. Therefore, the microcomputer 80 controls the switching element 162 by receiving the dimming signal from the external dimmer 6 to control the current flowing through the light source load 3, thereby realizing the dimming control.

The control circuit 4 of the present embodiment is described below.

An input terminal of the three-terminal regulator 79 is connected to a positive electrode of the smoothing capacitor 73, while an output terminal of the three-terminal regulator 79 is connected to the twenty-seventh pin P27 (a power terminal) of the microcomputer 80. A capacitor 791 is connected between the input terminal and a ground terminal of the three-terminal regulator 79. A capacitor 792 is connected between an output terminal and the ground terminal of the three-terminal regulator 79. The twenty-eighth pin P28 (a ground terminal) of the microcomputer 80 is connected to ground. Thus, the three-terminal regulator 79 is configured to convert the voltage across the smoothing capacitor 73 (power supply voltage VC1) into the power supply voltage VC2 for a microcomputer (herein, 5V) across the capacitor 792, thereby supplying power to the microcomputer 80.

The twenty-second pin P22 of the microcomputer 80 is connected to the external dimmer 6 through the signal line connector 17, and is supplied with the dimming signal from the external dimmer 6 through the dimming signal line 5. As mentioned above, the dimming signal line 5 is supplied with the dimming signal including a rectangular wave voltage signal, wherein the duty ratio of the rectangular wave voltage signal is variable, and the frequency and amplitude of the rectangular wave voltage signal are, for example, 1 kHz and 5 V, respectively. The microcomputer 80 is configured to output, from the nineteenth pin P19, the rectangular wave signal S3 for turning on and off of the switching element 162 in accordance with the duty ratio of the dimming signal. The driver circuit 81 drives the switching element 162 in accordance with the rectangular wave signal S3.

The driver circuit 81 has the first to sixth pins (P81-P86). The first pin P81 is a positive input terminal, and is connected to the nineteenth pin P19 of the microcomputer 80 through a resistor 82 of, e.g., 1 kΩ. A connection point between the resistor 82 and the nineteenth pin P19 of the microcomputer 80 is connected to ground through a resistor 83 of, e.g., 100 kΩ. The second pin P82 is a ground terminal and connected to ground. The third pin P83 is a negative input terminal and connected to ground. The fourth pin P84 is an output terminal (a SYNC output terminal) of a built-in N-channel MOSFET and connected to the gate terminal of the switching element 162 through a resistor 84 of, e.g., 10Ω. The fifth pin P85 is an output terminal (a source output terminal) of a built-in P-channel MOSFET and connected to the gate terminal of the switching element 162 through a resistor 85 of, e.g., 300Ω. The gate terminal of the switching element 162 is also connected to ground through a resistor 90. The sixth pin P86 is a power terminal, and is connected to the positive electrode of the smoothing capacitor 73 and also connected to ground through a capacitor 86 of, e.g., 0.1 μF. The sixth pin P86 is supplied with the power supply voltage VC1 (the voltage across the smoothing capacitor 73).

The driver circuit 81 amplifies the rectangular wave signal S3 having an amplitude of, e.g., 5V from the microcomputer 80 so that the amplitude becomes, e.g., 15V, and supplies the amplified signal to the gate terminal of the switching element 162, thereby turning the switching element 162 on and off.

Here, in the present embodiment, the three-terminal regulator 79 is, for example, "TA78L05" from Toshiba Co., the microcomputer 80 is an 8-bit microcomputer "78K0/Ix2" from RENESAS Co., and the driver circuit 81 is "MAX15070A" from Maxim Co. Here, as an example, the inductor 163 is set to be 1.2 mH and the output capacitor 164 is set to be 1 μF.

Figure 11:
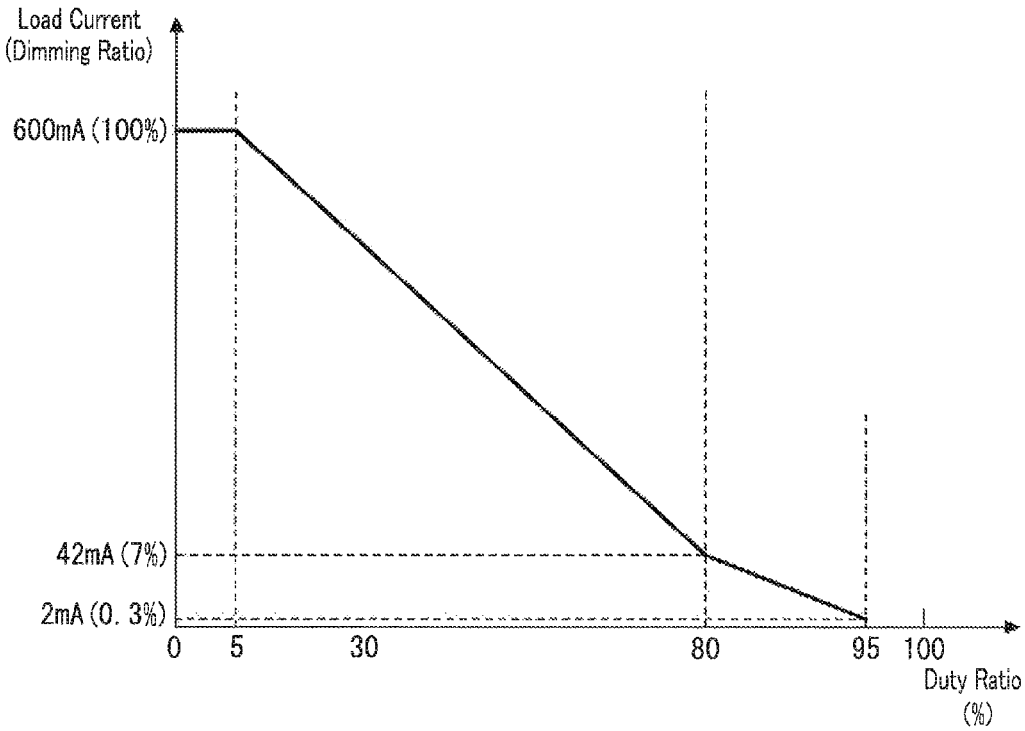
FIG. 11 is a view for describing the operation of the lighting apparatus according to the second embodiment.

In the present embodiment, the lighting apparatus 1 is adapted so that according to the duty ratio (the dimming ratio) of the dimming signal, the lighting apparatus 1 switches the full lighting state in which full lighting of the light source load 3 is performed and the first and second dimming states in which the light source load 3 is dimmed. As shown in FIG. 11, the dimming range of the present embodiment includes a first dimming interval (100% to 7%) and a second dimming interval (7% to 0.3%). In the first dimming interval, the lighting apparatus 1 of the present embodiment controls the light source load 3 based on the third control mode in which the On time of the switching element 162 is approximately fixed and the oscillating frequency of the switching element 162 is changed. Here, a first dimming state is defined as a state in which the dimming ratio is a minimum (7%) of the first dimming interval. In the second dimming interval, the lighting apparatus 1 of the present embodiment controls the light source load 3 based on the second control mode in which the oscillating frequency of the switching element 162 is approximately fixed and the On time of the switching element 162 is changed, from the first dimming state. Here, a second dimming state is defined as a state in which the dimming ratio is a minimum (0.3%) of the second dimming interval.

Next, an operation of the lighting apparatus 1 according to the present embodiment will be described with reference to FIG. 11. In FIG. 11, the horizontal axis represents the duty ratio (On duty) of the dimming signal (the PWM signal) from the external dimmer 6, and the vertical axis represents the load current (an effective value of the output current supplied to the light source load 3) and the dimming ratio (in parentheses in FIG. 11) in which the load current of 600 mA is defined as the full lighting (100%).

First, the first control mode is allocated for an interval (a first interval) in which a duty ratio of the PWM signal is in a range of 0 to 5%. In the first interval, the microcomputer 80 outputs the constant rectangular wave signal S3 for driving the switching element 162 from the nineteenth pin P19. In this case, the rectangular wave signal S3 in the embodiment is set so that the oscillating frequency is 140 kHz, the On time is 5 μs and the voltage value is 5 V. The driver circuit 81 amplifies the voltage value to 15 V by receiving the rectangular wave signal S3 and supplies the amplified signal to the gate of the switching element 162 of the step-down chopper circuit 16 to turn the switching element 162 on and off. In this case, the lighting apparatus 1 is operated in the full lighting state and the output current of 600 mA in average flows through the light source load 3 (the dimming ratio of 100%). The lighting apparatus 1 continues the state (the full lighting state) until the duty ratio of the dimming signal reaches 5%. In this case, the output current supplied from the lighting apparatus 1 to the light source load 3 is smoothed with the output capacitor 164 so that the ripple ratio (IPP/Ia) is less than 0.5.

Next, the third control mode is allocated for an interval (a second interval) in which a duty ratio of the dimming signal is a range of 5 to 80%. This second interval corresponds to the first dimming interval of the dimming range. In this interval, the microcomputer 80 gradually reduces the oscillating frequency of the rectangular wave signal S3 supplied from the nineteenth pin P19 according to the increase in the duty ratio of the dimming signal. In the present embodiment, the microcomputer 80 approximately maintains the On time of the rectangular wave signal as a predetermined value (5 μs) and gradually increases the Off time of the rectangular wave signal S3 according to the increase in the duty ratio of the dimming signal. Here, the program of the microcomputer 80 is set so that the oscillating frequency of the rectangular wave signal S3 supplied from the nineteenth pin P19 is 8 kHz when the duty ratio of the dimming signal is 80%. In this case, the lighting apparatus 1 is operated in the first dimming state and an average of the output current flowing through the light source load 3 is controlled to 42 mA (the dimming ratio of 7%) as a lower limit.

The second control mode is allocated for an interval (a third interval) in which a duty ratio of the dimming signal is a range of 80 to 95%. This third interval corresponds to the second dimming interval of the dimming range. In this interval, the microcomputer 80 gradually reduces the On time of the rectangular wave signal S3 supplied from the nineteenth pin P19 according to the increase in the duty ratio of the dimming signal. In the present embodiment, the microcomputer 80 changes the On time according to the duty ratio of the dimming signal while making the oscillating frequency approximately constant at a predetermined value (8 kHz). Here, the program of the microcomputer 80 is set so that the On time of the rectangular wave signal S3 supplied from the nineteenth pin P19 is 0.5 μs when the duty ratio of the dimming signal is 95%. In this case, the lighting apparatus 1 is operated in the second dimming state and an average of the output current flowing through the light source load 3 is controlled to 2 mA (the dimming ratio of 0.3%) as a lower limit.

In the present embodiment, the lighting apparatus 1 stops the operation of the step-down chopper circuit 16 and turns the light source load 3 off by setting the output from the nineteenth pin P19 of the microcomputer 80 to the L level in an interval (a fourth interval) in which a duty ratio of the PWM signal is in a range of 95% or more (see FIG. 11).

According to the lighting apparatus 1 of the present embodiment as described above, the control circuit 4 dims the light source load 3 by arbitrarily selecting the second control mode for changing the On time of the switching element 162 and the third control mode for changing the oscillating frequency in a multi stage. Therefore, when compared with the case in which the light source load 3 is dimmed based on only the second control mode or the third control mode, the lighting apparatus 1 may expand the dimming range of the light source load 3 without flickering the light source load 3. As a result, the lighting apparatus 1 can precisely (finely) control the brightness of the light source load 3 over the relatively wide range.

In addition, the control of the dimming ratio in the dimming state is performed with the microcomputer 80 of the control circuit 4, such that the lighting apparatus 1 that can precisely (finely) control the brightness of the light source load 3 with the relatively simple configuration can be realized.

Other components and functions are the same as the first embodiment.

Figure 12:
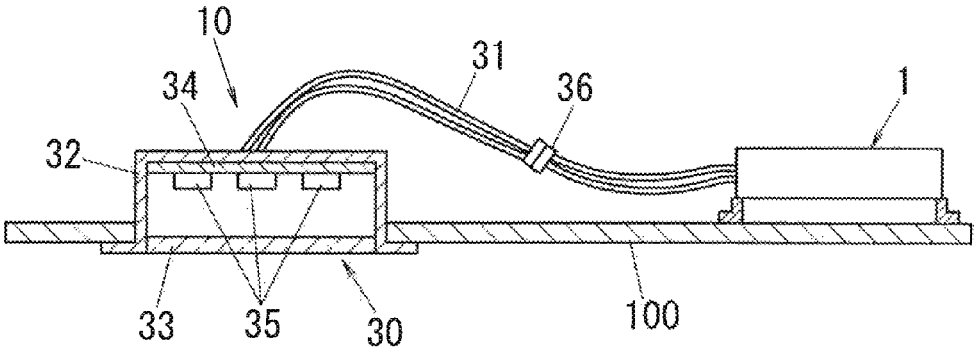
FIG. 12 is a sectional view showing an illuminating fixture including the lighting apparatus.

Here, each lighting apparatus 1 described in the embodiments configures an illuminating fixture together with the light source load 3 comprising the semiconductor light emitting device (LED module). As shown in FIG. 12, in the illuminating fixture 10, the lighting apparatus 1 as a power supply unit is received in a casing separate from an appliance housing 32 of the LED module (the light source load 3) 30. The lighting apparatus 1 is connected to the LED module 30 through a lead wire 31. Therefore, the illuminating fixture 10 can implement the slimness of the LED module 30 and increase the degree of freedom of the installation place of the lighting apparatus 1 as a separate mounting type of the power supply unit.

In the example of FIG. 12, the appliance housing 32 made of a metal material is formed in a cylinder shape having an upper base and an opened bottom. The opened surface (the bottom surface) is covered with a light diffusing sheet 33. In the LED module 30, a plurality of (herein, four) LEDs 35 are mounted on one surface (lower surface) of a substrate 34 and are disposed in a relationship opposite to (facing) the light diffusing sheet 33 within the appliance housing 32. The appliance housing 32 is buried in a ceiling 100 and is connected to the lighting apparatus 1 as the power supply unit disposed behind the ceiling through the lead wires 31 and connectors 36.

The illuminating fixture 10 is not limited to a separate mounting type configuration in which the lighting apparatus 1 as the power supply unit is received in the casing separate from that of the LED module 30. For example, the fixture 10 may be a power supply integrated type configuration in which the LED module 30 and the lighting apparatus 1 are received in the same housing.

Each lighting apparatus 1 described in the embodiments is not limited to be used for the illuminating fixture 10. Each lighting apparatus 1 may be used for various light sources, for example, a backlight of a liquid crystal display, a copier, a scanner, a projector, and the like. Alternatively, the light source load 3 emitting light by receiving the power supply from the lighting apparatus 1 is not limited to the light emitting diode (LED). For example, the light source load 3 may comprise a semiconductor light emitting element such as, for example, an organic EL device, a semiconductor laser device, etc.

Further, in each embodiment, the step-down chopper circuit 16 has a configuration in which the switching element 162 is connected to the low potential (negative) side of the output terminals of the DC power supply circuit 15 and the diode 161 is connected to the high potential (positive) side thereof, but it is not limited thereto. That is, the step-down chopper circuit 16 may have a configuration in which the switching element 162 is connected to the high potential side of the output terminals of the DC power supply circuit 15, as shown in FIG. 13A.

Figure 13:
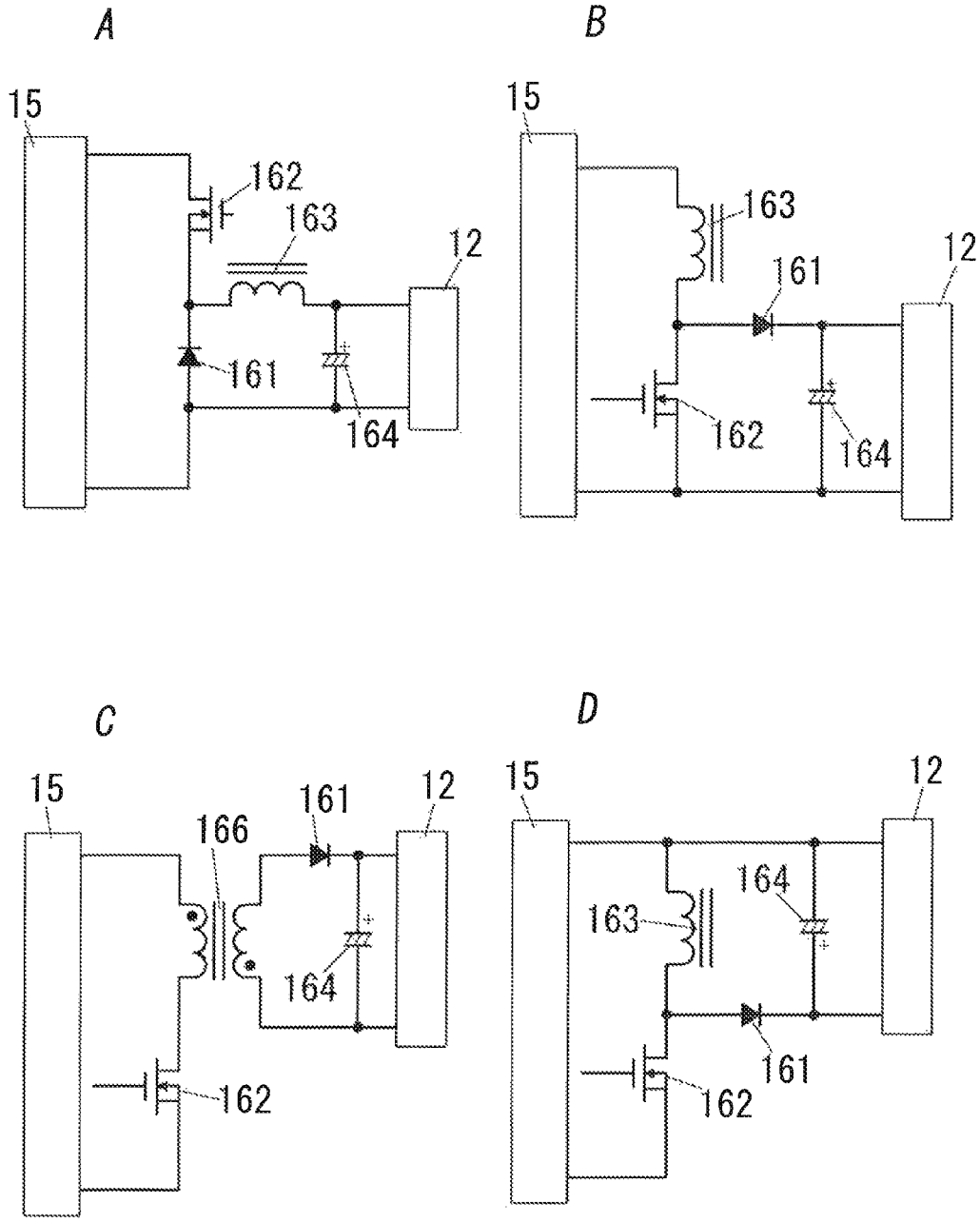
FIG. 13A to 13D are circuit diagrams showing a major portion of another configurations of the lighting apparatus.

The lighting apparatus 1 is not limited to the configuration in which the step-down chopper circuit 16 is applied thereto, but as shown in FIGS. 13B to 13D, the lighting apparatus 1 may include various switching power supply circuits other than the step-down chopper circuit formed between the DC power supply circuit 15 and the output connector 12. FIG. 13B shows the case in which the step-up chopper circuit is applied, FIG. 13C shows the case in which a flyback converter circuit is applied, and FIG. 13D shows the case in which the step-down and step-up chopper circuit is applied.

The step-up chopper circuit shown in FIG. 13B is configured so that the inductor 163 and the switching element 162 are connected in series between the output terminals of the DC power supply circuit 15, and the diode 161 and the output capacitor 164 are connected in series between both terminals of the switching element 162. The flyback converter circuit shown in FIG. 13C is configured so that a primary winding of a transformer 166 and the switching element 162 are connected in series between the output terminals of the DC power supply circuit 15, and the diode 161 and the output capacitor 164 are connected in series to each other and connected in parallel with a secondary winding of the transformer 166. The step-down and step-up chopper circuit shown in FIG. 13D is configured so that the inductor 163 and the switching element 162 are connected in series between the output terminals of the DC power supply circuit 15, and the diode 161 and the output capacitor 164 are connected in series to each other and connected in parallel with the inductor 163.

The invention claimed is:

1. A lighting apparatus, comprising:

a switching element connected in series to a DC power supply and controlled to be turned on and off at high frequency;

an inductor through which a current flows from the DC power supply when the switching element is turned on, said inductor being connected in series to the switching element;

a diode that discharges electromagnetic energy stored in the inductor, when the switching element is turned on, to a light source load comprising a semiconductor light emitting element when the switching element is turned off;

an output capacitor connected in parallel with the light source load and adapted to smooth a pulsation component of an output current supplied to the light source load, said pulsation component being caused by the turning on and off of the switching element; and a control circuit adapted to control an On and Off operation of the switching element, wherein the control circuit comprises first, second and third control modes as control modes of the switching element, and is adapted:

(A), in the first control mode, to turn the switching element on and off at a predetermined oscillating frequency and an On time so that a current flows through the inductor in a continuous mode in which the current continuously flows through the inductor without a sleep period;

(B), in the second control mode, to fix the oscillating frequency of the switching element and change the On time of the switching element; and (C), in the third control mode, to fix the On time of the switching element and change the oscillating frequency of the switching element, wherein the second control mode and the third control mode are allocated for at least two dimming intervals of intervals into which a dimming range between a minimum dimming ratio and a maximum dimming ratio is divided, and wherein the control circuit is adapted:

(i), if a full lighting mode is designated, to select the first control mode to fully light the light source load; and (ii), if a dimming ratio is designated from the dimming range, to select one of the second and third control modes according to the dimming interval, to which the dimming ratio corresponds, to dim the light source load at the designated dimming ratio.

2. The lighting apparatus according to claim 1, wherein the output capacitor has capacity set so that a ripple ratio of the output current is less than 0.5 when the light source load is fully lit.

3. The lighting apparatus according to claim 1, further comprising:

a current sensing unit for sensing the current flowing through the switching element; and a capacitor adapted to be charged by a driving signal of the switching element, wherein the control circuit is adapted:

to turn the switching element off when the current sensed by the current sensing unit reaches a predetermined first value: and to turn the switching element on when a value of a voltage across the capacitor is a predetermined threshold value or less, and wherein the control circuit is adapted:

to change the first value, thereby changing the On time of the switching element; and to change a predetermined second value determining a discharge speed of the capacitor, thereby changing the oscillating frequency of the switching element.

4. The lighting apparatus according to claim 3, wherein the control circuit is adapted to set at least one of the first and second values to be zero or less, thereby stopping the On and Off operation of the switching element to turn the light source load off.

5. The lighting apparatus according to claim 1, wherein the control circuit is adapted to receive a dimming signal from outside to select a control mode of the switching element according to the dimming ratio determined by the dimming signal.

6. The lighting apparatus according to claim 1, wherein the control circuit is adapted to set the oscillating frequency of the switching element to be in a range of 1 kHz or more.

7. An illuminating fixture comprising:

the lighting apparatus according to claim 1; and the light source load adapted to be supplied with power from the lighting apparatus.

* * * * *